United States Patent [19]

Ferdinand

[11] 4,233,912

[45] Nov. 18, 1980

[54] SHELF STANDARD

[75] Inventor: Irwin J. Ferdinand, Glencoe, Ill.

[73] Assignee: Hirsh Company, Skokie, Ill.

[21] Appl. No.: 32,415

[22] Filed: Apr. 23, 1979

[51] Int. Cl.[3] ..... A47B 47/02

[52] U.S. Cl. ..... 108/109; 108/152

[58] Field of Search ..... 108/107, 108, 109, 110, 108/152, 149, 114, 106; 211/191; 248/243

[56] References Cited

U.S. PATENT DOCUMENTS

| | | | |
|---|---|---|---|
| 1,851,192 | 3/1932 | Lange | 108/106 X |
| 2,909,289 | 10/1959 | Laurie | 108/107 X |
| 3,199,471 | 8/1965 | Orsi | 108/114 |
| 3,265,018 | 8/1966 | Joyce | 108/109 |
| 3,276,403 | 10/1966 | Ferdinand et al. | 108/106 X |
| 3,340,829 | 9/1967 | Palmer | 108/149 |
| 3,770,135 | 11/1973 | Schild | 108/108 |

*Primary Examiner*—Francis K. Zugel

*Attorney, Agent, or Firm*—Dressler, Goldsmith, Shore, Sutker & Milnamow, Ltd.

[57] ABSTRACT

A shelf standard is provided with one backwall and two sidewalls. The sidewalls have cut-out portions which receive shelving. The backwall has a center section panel which extends from the backwall a distance greater than the distance from the backwall to the sidewall edge defining the cut-out portion and acts to keep the shelving edge free from contact with the sidewall edge when the shelving is being located in position.

1 Claim, 3 Drawing Figures

Fig. 1
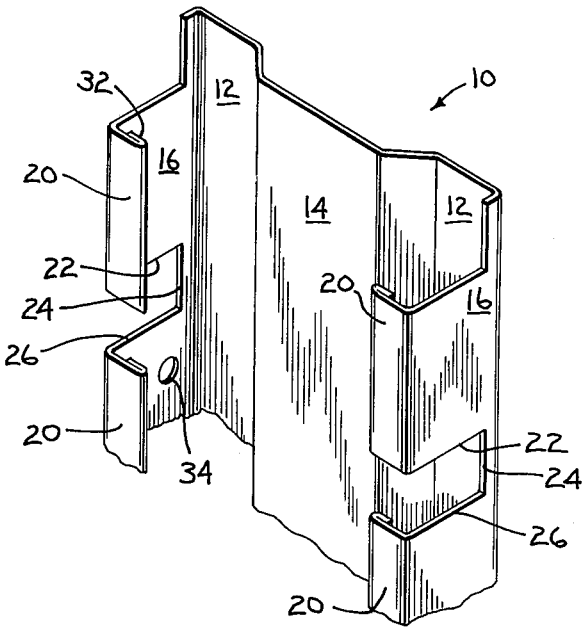
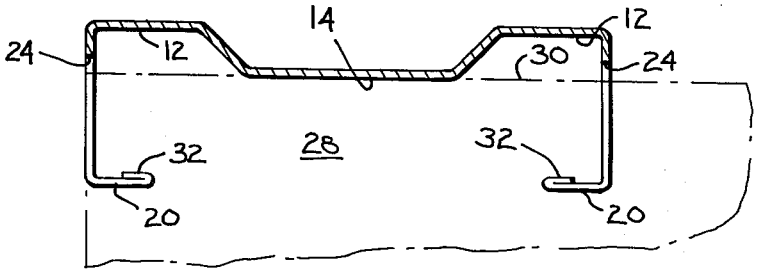
Fig. 2
Fig. 3
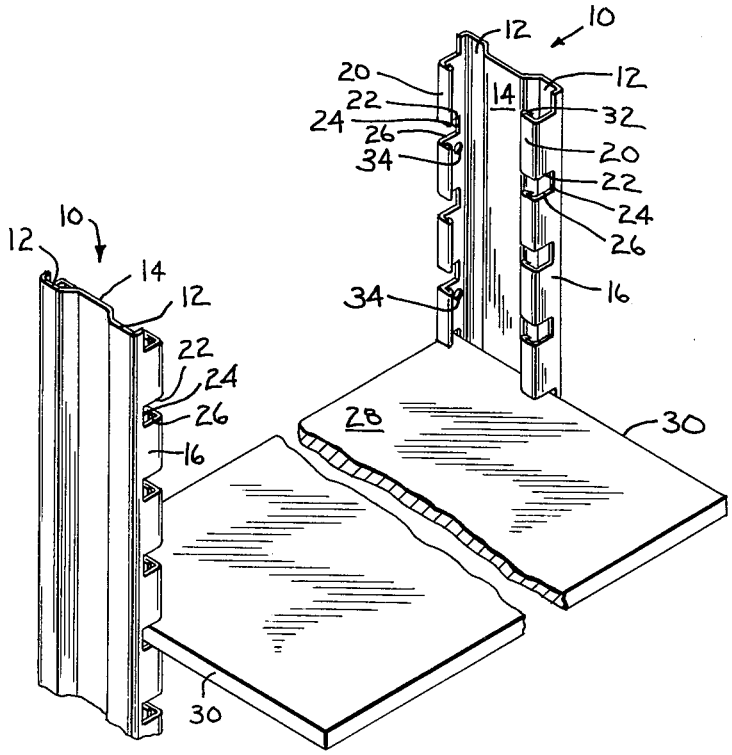

SHELF STANDARD

BACKGROUND OF THE INVENTION

This invention pertains to the art of shelving supports and more particularly to shelf standards.

Prior art devices have included shelf standards which chafe or chip shelf edges or other shelf surfaces when the shelf is being inserted or removed from the standard. This chafing or chipping occurs because the standards have sharp edges which scrape the edge of the shelf when the shelf is moved relative to the standard.

Prior art devices also allow the shelves to shift relative to the standard even when fully received by the standard.

Prior art devices also allow the shelves to shift relative to the standard even when fully received by the standard.

The present invention overcomes the deficiencies of the prior art in this field by providing for a standard which substantially eliminates chafing or chipping of a shelf edge and by providing for a means to keep the shelf in a fixed position when the shelf is fully received by the standard.

Other advantages of the present invention will become apparent as the description proceeds.

SUMMARY OF THE INVENTION

In accordance with the present invention, a shelf standard is provided with one backwall and two parallel sidewalls. The sidewalls have openings which are designed to receive shelves. The backwall has a center section panel which extends forward from the backwall a distance greater than the distance from the backwall to the sidewall edges defining the opening and thus serves as a flat guide which keeps the shelving edge free from contact with the sidewall edge to avoid chafing or chipping of the shelf edge as it is being moved relative to the shelf support.

In the illustrative embodiment, the sidewalls contain frontal flanges which strengthen the standard and help prevent its buckling when loads are exerted upon the shelf when located in place.

A more detailed explanation of the invention is provided in the following description and claims, and is illustrated in the accompanying drawings.

BRIEF DESCRIPTION OF THE DRAWINGS

FIG. 1 is a perspective view of the shelving standard;

FIG. 2 is a plan view showing the shelving standard in partial cross-section and with a section of shelving shown cut away; and FIG. 3 is a perspective view of 2 shelving standards cooperatively supporting a section of shelving.

DESCRIPTION OF THE PREFERRED EMBODIMENTS

The novel shelf standard is generally channel-shaped and consists of backwall sections 12, center section panel 14, and forwardly extending parallel mounting sidewall sections 16. Extending inwardly from the sidewall sections 16 are front sections 20.

The shelf standard includes a series of longitudinally spaced cut-out portions which serve to receive spaced shelves. Each cut-out portion is defined by aligned top edges 22, side edges 24 and bottom edge 26 in the sidewall sections 16.

As shown in FIG. 3, these cut-out portions enable the shelf standard 10 to receive and support shelving 28 when the standard 10 is in the vertical position. Since the cut-out portions are placed periodically along the length of the standard 10, shelf 28 can be placed at a desired height or removed if a different shelf level is later desired.

Referring now to FIG. 2, it is seen that the center section panel 14 extends from backwall sections 12 a distance greater than the distance from backwall sections 12 to the sidewall side edge 24. This novel design feature serves to keep the edge 30 of shelf 28 free from contact with the sidewall side edge 24 as the shelf is moved into supporting position within the standard as shown in FIG. 2 to substantially eliminate any cutting or shearing during insertion thereof. Such damage would occur repeatedly every time the shelf was moved relative to the standard if the present invention was not employed. This center section panel, in addition to providing the above important advantage, also, due to its design, adds substantial column strength to the standard 10.

The front sections 20 are also provided with reversely bent flanges 32 which provide additional strength to the standard to help support the shelving.

In a typical installation, as shown in FIG. 3, two shelving standards are affixed in position and separated by a distance determined by the length of the shelving to be used so that the shelf edges 26 are in firm contact with the center section panels 14. This prevents lateral shifting of the shelf.

The shelf support 10 is also provided with a series of mounting holes 34 along mounting sidewall section 16 so that the shelving standard 10 can be mounted to a vertical surface with screws or the like.

Mounting holes 34 can be provided along both sidewall sections 16 and thus there is no need to have right and left-handed standards since they are obviously freely interchangeable.

It is, of course, intended to cover by the appended claims all modifications that fall within the true spirit and scope of the invention.

What is claimed is:

1. A shelf support system comprising two shelf standards, each standard having one backwall and two sidewalls each defining aligned cut-out portions circumscribed by a first edge generally parallel to said backwall and second parallel edges normal to said first edge to define an opening adapted to receive shelving, said backwall having a center section panel which extends forwardly from the backwall a distance greater than the distance from the backwall to said first edge to keep the edge of the shelving being inserted and removed from the shelf support free from contact with said first edge to prevent chafing, shearing or other damage to the shelf when it is being moved relative to the support, each standard also having at least one front section extending from one sidewall generally toward the other sidewall, and generally parallel to the backwall which contains a flange to and in support of shelving when said shelving is fully received by the cut-out portion immediately above said front section, whereby the two shelf standards face each other a distance determined by the length of the shelfs to be supported so that the shelf edges are in firm contact with the center section panels of the standards and so that the shelf is restricted from lateral shifting when fully received by said standards.

* * * * *